US005168852A

United States Patent [19]

Moriguchi et al.

[11] Patent Number: 5,168,852

[45] Date of Patent: Dec. 8, 1992

[54] THROTTLE RETURN SPRING ASSEMBLY FOR AN ENGINE INTAKE THROTTLE VALVE RETURN DEVICE

[75] Inventors: Teruhiko Moriguchi; Yutaka Okaue; Manabu Hirai; Osamu Matsumoto; Tsuneo Yamane, all of Himeji, Japan

[73] Assignee: Mitsubishi Denki Kabushiki Kaisha, Tokyo, Japan

[21] Appl. No.: 798,584

[22] Filed: Nov. 26, 1991

[30] Foreign Application Priority Data

Nov. 29, 1990 [JP] Japan ..... 2-336194

[51] Int. Cl.[5] ..... F02D 9/08

[52] U.S. Cl. ..... 123/400; 251/305; 251/337

[58] Field of Search ..... 123/399, 400, 401, 361, 123/403; 251/305, 337; 267/155

[56] References Cited

U.S. PATENT DOCUMENTS 4,880,207 11/1989 Matsumoto ..... 251/337

FOREIGN PATENT DOCUMENTS 46346 3/1984 Japan .

195539 12/1985 Japan .

*Primary Examiner*—Willis R. Wolfe

*Attorney, Agent, or Firm*—Sughrue, Mion, Zinn, Macpeak and Seas

[57] ABSTRACT

A return spring assembly for use in an engine intake throttle valve return device comprising a spring holder sleeve (17) including an inner and outer sleeves (18,20) placed over a throttle valve shaft (3) and connected at one end to each other so that the inner and outer sleeves (18,20) are spacedly and concentrically held. Inner and outer torsion coil springs (8,9) are supported on the inner and outer sleeves (18,20), respectively, and connected between an intake barrel (1) and the valve shaft (3) for urging the throttle valve (2) to its closed position. An eccentric radial flange (22) which may be circular, oval or polygonal is provided on the outer sleeve (20) for holding the outer torsion coil spring (9). The eccentric flange (22) extends continuously over the entire circumference of the outer sleeve (20) and has a maximum outer diametrical dimension substantially equal to the inner diameter of the outer torsion coil spring (9). The eccentric flange (22) is eccentric with respect to the outer sleeve (20) by an amount effective to prevent the outer coil spring (9) from being disclocated from the outer sleeve (20).

4 Claims, 2 Drawing Sheets

THROTTLE RETURN SPRING ASSEMBLY FOR AN ENGINE INTAKE THROTTLE VALVE RETURN DEVICE

BACKGROUND OF THE INVENTION

This invention relates to a return spring assembly for an engine intake throttle valve return device and, more particularly, to improvements in a spring holder sleeve for holding throttle return springs.

FIG. 4 illustrates a conventional throttle valve return device and FIGS. 5 and 6 illustrate a spring holder sleeve used in the device illustrated in FIG. 4. In these figures, reference numeral 1 designates a barrel or a throttle body, 2 is a throttle valve mounted to a valve shaft 3. 4 is a throttle lever and 6 is a stop lever which are fitted over a notched portion 3*a* formed at one end of the valve shaft 3 and secured by a nut 5. A return spring holder sleeve 7 is disposed on an outer circumference of a cylindrical outer end portion 3*b* of the valve shaft 3. As best illustrated in FIGS. 5 and 6, the spring holder sleeve 7 has a general configuration in which a flange portion 7*a* integrally connects an inner sleeve 7*b* and an outer sleeve 7*c*. On the outer circumferences of the inner and outer sleeves 7*b* and 7*c*, inner and outer return springs 8 and 9, respectively, are wound. The return springs 8 and 9 are torsion coil springs. One end of each of the return springs 8 and 9 is connected to the stopper lever 6 and the other end is connected to a hook 1*a* provided on the barrel or the throttle body 1. The outer sleeve 7*c* has formed therein slits 7*d* and 7*e* for allowing the end portion of the inner spring 8 to pass and extend therethrough so that the out sleeve 7*c* does not interfere the inner spring 8. On the end of the spring holder sleeve 7 opposite to the flange portion 7*a*, a partial flange 7*f* is provided to partially extend along the outer circumference of the outer sleeve 7*c*. While the outer diameters of the flanges 7*a* and 7*f* are both larger than the inner diameter of the outer coil spring 9, since the flange 7*f* is only circumferentially partially provided and the larger portion of the circumference is not provided with the flange 7*f* and a large notch 7*h* is defined, the outer coil spring 9 can be placed over the outer sleeve 7*c* through this large notch 7*h*.

When an accelerator pedal (not shown) is depressed, the throttle lever 4 together with the valve shaft 3 is rotated against the return torsion coil springs 8 and 9 to rotate the throttle valve 2 into an open position. When the accelerator pedal is released, the spring forces of the inner and outer torsion coil springs 8 and 9 cause the valve shaft 3 together with the throttle valve 2 to return to its closed position illustrated in FIG. 4.

With the conventional engine intake throttle valve return device of the above construction, the flange 7*f* of the outer sleeve 7*c* is only partially provided in order to allow the outer torsion coil spring 9 to be fitted over the spring holder sleeve 7. Therefore, the outer sleeve 7*c* has only a limited radial mechanical strength or rigidity which is not entirely satisfactory. Also, the outer torsion coil spring 9 may relatively easily be dislocated from the holder sleeve 7 when the outer spring 9 oscillates in radial direction due to the vibration of the engine for example.

SUMMARY OF THE INVENTION

Accordingly, one object of the present invention is to provide a throttle return spring assembly for an engine intake throttle valve return device free from the abovediscussed problems of the conventional intake throttle valve return device.

Another object of the present invention is to provide a throttle return spring assembly for an engine intake throttle valve return device in which the outer return spring can be easily mounted on the holder sleeve.

Another object of the present invention is to provide a throttle return spring assembly for an engine intake throttle valve return device which is easy to manufacture and yet reliable.

A still another object of the present invention is to provide a throttle return spring assembly for an engine intake throttle valve return device in which the outer spring holder sleeve has a higher mechanical strength and the outer torsion coil spring is not easily dislocated from the sleeve.

With the above objects in view, the throttle return spring assembly for an engine intake throttle valve return device of the present invention comprises a spring holder sleeve adapted to be mounted on a throttle valve shaft rotatable on an intake barrel. The spring holder sleeve comprises a cylindrical inner sleeve placed over the valve shaft and having a first end and a second end, an end plate connected to the first end of the inner sleeve and extending radially outwardly therefrom and a cylindrical outer sleeve having a first end and a second end and connected at its first end to an outer end of the end plate so that the inner and outer sleeves are held in a spaced, substantially concentric relationship to each other. An inner torsion coil spring is disposed between the inner and outer sleeves over the valve shaft and connected between the intake barrel and the valve shaft for urging the throttle valve to its closed position, and an outer torsion coil spring disposed over the outer sleeve and connected between the barrel and the valve shaft for urging the throttle valve to its closed position. The spring holder sleeve also comprises a first flange extending radially outwardly from the first end of the outer sleeve for holding the outer torsion coil spring against axial movement. The first flange has an outer diameter larger than the inner diameter of the outer torsion coil spring. The spring holder sleeve further comprises a second flange extending radially outwardly from the second end of the outer sleeve for holding the outer torsion coil spring against axial movement. The second flange also extends continuously over substantially entire circumference of the outer sleeve and has a maximum outer diametrical dimension substantially equal to the inner diameter of the outer torsion coil spring. The second flange is eccentric with respect to the outer sleeve by an amount effective to prevent the outer torsion coil spring from being dislocated from the outer sleeve.

In one embodiment of the present invention, the eccentric second flange may have a circular configuration having an outer diameter substantially equal to the inner diameter of the outer torsion coil spring. Alternatively, the eccentric second flange may have an oval configuration or a polygonal configuration.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
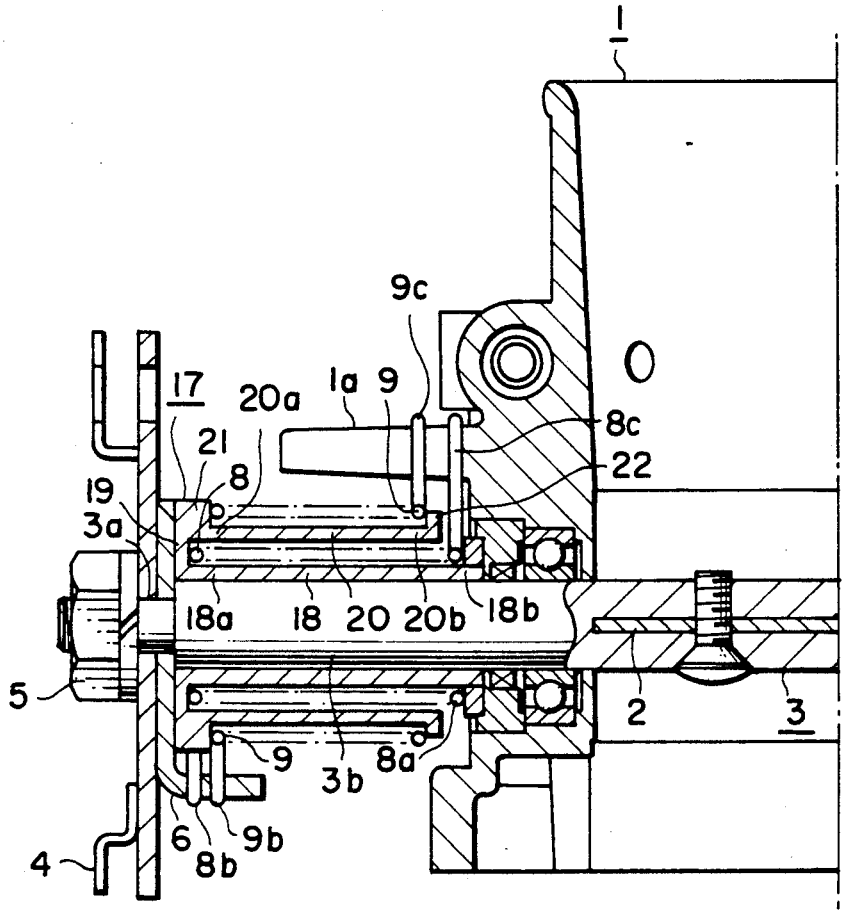
FIG. 1 is a sectional view of the throttle return spring assembly for an engine intake throttle valve return device constructed in accordance with the present invention.
Figure 2:
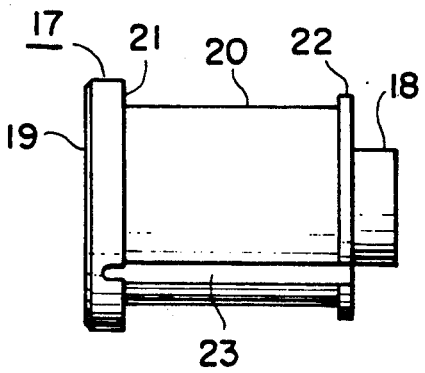
FIG. 2 is a side view of the spring holder sleeve of the return spring assembly illustrated in FIG. 1.

FIG. 1 illustrates a throttle valve return spring assembly for an intake throttle valve return device of an engine constructed in accordance with the present invention. The throttle valve return spring assembly is used with a throttle valve 2 disposed within an intake barrel 1 of a carburetor of an engine. The throttle valve 2 is rotatably supported by a rotatable valve shaft 3 which has an outer end 3*b* extending outwardly of the intake barrel 1.

The throttle valve return spring assembly comprises a spring holder sleeve 17 made preferably of a suitable plastic material and is mounted on an outer end 3*b* of the rotatable valve shaft 3. The spring holder sleeve 17 is held in the illustrated axial position on the valve shaft 3 by a stop lever 6 and a throttle lever 4 which are fitted over the notched boss 3*a* and which are secured by a nut 5. Thus, when the throttle lever 4 is rotated, the spring stop lever 6 and the valve shaft 3 and the throttle valve 2 are also rotated. The return spring assembly also comprises inner and outer torsion coil springs 8 and 9 wound about the spring holder sleeve 17 and connected between a spring hook 1*a* on the barrel 1 and the stop lever 6 on the valve shaft 3 for urging the throttle valve 2 on the shaft 3 into its closed position. The inner torsion coil spring 8 comprises a coiled portion 8*a* and two straight end portions 8*b* and 8*c*, and the outer torsion coil spring 9 comprises a coiled portion 9*a* and two straight end portions 9*b* and 9*c*. The coiled portions 8*a* and 9*a* are placed over the spring holder sleeve 17, the straight end portions 8*b* and 9*b* are engaged by the stopper lever 6, and other end portions 8*c* and 9*c* are connected to the hook 1*c* on the barrel 1.

As best illustrated in FIG. 1, the spring holder sleeve 17 is of generally double-wall tube structure. The spring holder sleeve 17 comprises a cylindrical inner sleeve 18 having a first end 18*a* and a second end 18*b* and adapted to be fitted over the outer end 3*b* of the valve shaft 3 through a bore 18*c*. An end plate 19 extending in the radially outward direction is integrally connected to the first end 18*a* of the inner sleeve 18. The spring holder sleeve 17 also comprises a cylindrical outer sleeve 20 having a first end 20*a* and a second end 20*b* and connected at its first end 20*a* to a radially outer end of the end plate 19 so that the inner and outer sleeves 18 and 20 are held in a spaced, substantially concentric relationship to each other to define an annular space between the inner and outer sleeves 18 and 20 for receiving the inner torsion coil spring 8 therein. The outer sleeve 20 is provided at its first end 20*a* connected to the inner sleeve 18 through the end plate 19 with a circular first flange 21 for limiting any axial movement of the coil spring 9 beyond the first flange 21. The outer sleeve 20 is also provided at its second end 20*b* with a circular second flange 22 for holding the coil spring 9 in the predetermined position on the holder sleeve 17.

The first flange 21 which extends radially outwardly from the first end 20*a* of the outer sleeve 20 for holding the outer torsion coil spring 9 against axial movement has a circular contour concentric with the central axis 17*a* (see FIG. 3) of the spring holder sleeve 17 inner and outer sleeves 18 and 20 and having an outer diameter larger than the inner diameter of the coiled portion 9*a* of the outer torsion coil spring 9 (see FIG. 1).

Figure 3:
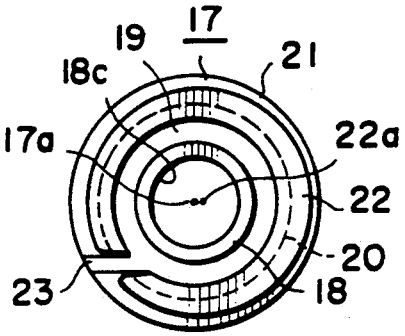
FIG. 3 is a front view of the spring holder sleeve of the return spring assembly illustrated in FIG. 2.
Figure 4:
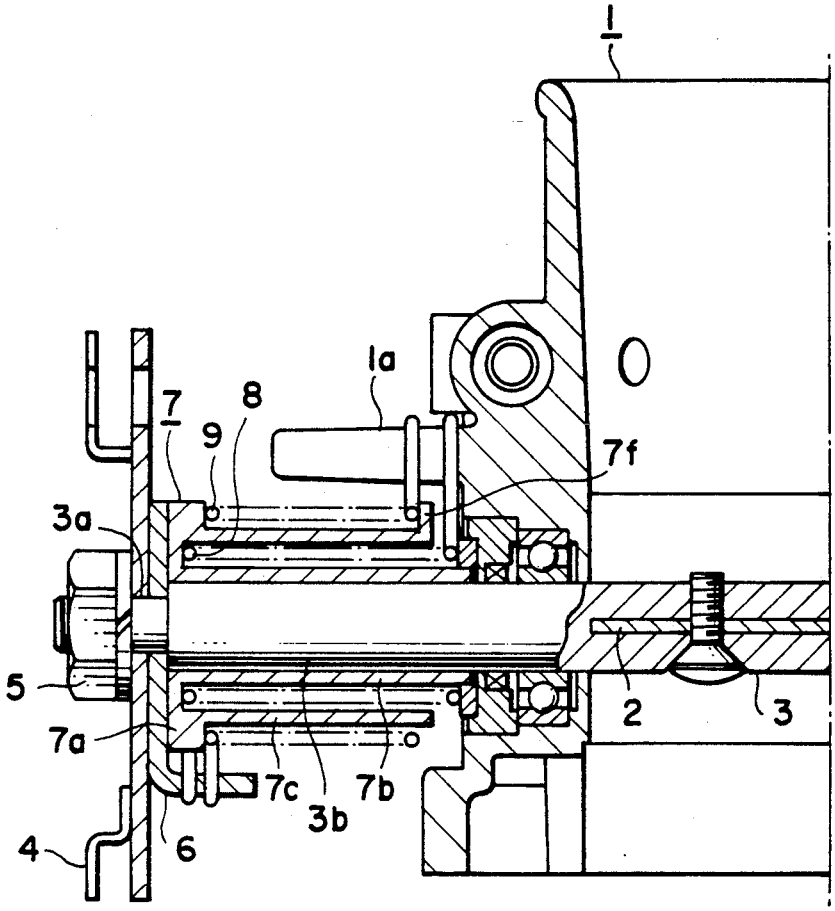
FIG. 4 is a sectional view of the conventional engine intake throttle valve return device.
Figure 5:
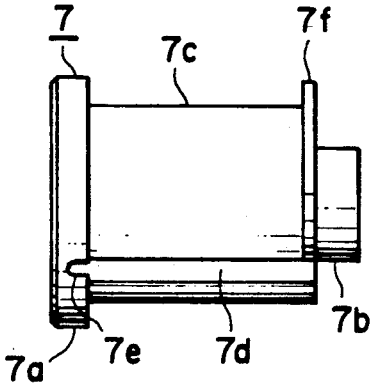
FIG. 5 is a side view of the conventional spring holder sleeve illustrated in FIG. 4.
Figure 6:
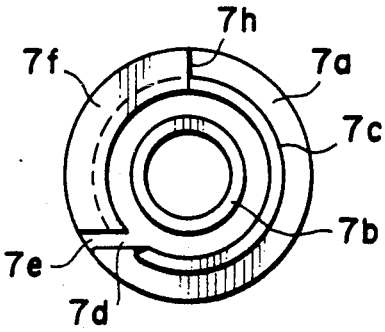
FIG. 6 is a front view of the spring holder sleeve illustrated in FIG. 5.

The second flange 22 extends radially outwardly from the second end 20*b* of the outer sleeve 20 for holding the outer torsion coil spring 9 against axial movement. The second flange 22 extends also continuously over substantially entire circumference of the outer sleeve 20. The second flange 22 has a maximum outer diametrical dimension substantially equal to the inner diameter of the coiled portion 9*a* of the outer torsion coil spring 9 so that the coiled portion 9*a* is allowed to pass over the second flange 22. In the illustrated embodiment, the second flange 22 has a circular configuration as seen from FIG. 3, but may be oval or polygonal in outer contour as long as the maximum outer diametrical dimension does not exceed the inner diameter of the coiled portion 9*a* of the outer torsion coil spring 9. As illustrated in FIG. 3, the second flange 22 is eccentric with respect to the outer sleeve 20 by an amount effective to prevent the coiled portion 9*a* of the outer torsion coil spring 9 from being dislocated from the outer sleeve 20. In other words, the eccentric second flange 22 has its center 22*a* displaced from the center 17*a* of the spring holder sleeve 17.

The spring holder sleeve 17 has formed a continuous slit 23 extending through the second flange 22, the outer sleeve 20 and the first flange 19 for allowing and receiving the straight portion 8*b* of the inner torsion coil spring 8.

As has been described, the throttle return spring assembly of the present invention comprises a spring holder sleeve for supporting a return spring thereon. The spring holder sleeve comprises a spaced concentric inner and outer sleeves, and the outer sleeve has a concentric first flange of a diameter larger than the inner diameter of the outer return coil spring and an eccentric second flange of a diameter or a maximum diametrical dimension substantially equal to the inner diameter of the outer return coil spring. The eccentric flange extends through the entire circumference of the outer sleeve and is eccentric by an amount effective to prevent the outer torsion coil spring from being dislocated from the outer sleeve.

Therefore, in the throttle return spring assembly for an engine intake throttle valve return device of the present invention, the outer return spring can be easily mounted on the spring holder sleeve and easy to manufacture. Also, the return spring is not easily dislocated from the spring holder sleeve by engine vibrations. Further, the outer spring holder sleeve has a higher rigidity and reliability.

What is claimed is:

1. A return spring assembly for use in an intake throttle valve return device of engine, comprising:

a spring holder sleeve adapted to be mounted on a throttle valve shaft rotatable relative to an intake barrel, said spring holder sleeve comprising a cylindrical inner sleeve placed over said valve shaft and having a first end and a second end, an end plate connected to said first end of said inner sleeve and extending radially outwardly therefrom and a cylindrical outer sleeve having a first end and a second end and connected at its first end to an outer end of said end plate so that said inner and outer sleeves are held in a spaced substantially concentric relationship to each other;

an inner torsion coil spring disposed between said inner and outer sleeves over said valve shaft and adapted to be connected between said barrel and said valve shaft for urging said throttle valve to its closed position; and an outer torsion coil spring disposed over said outer sleeve and adapted to be connected between said barrel and said valve shaft for urging said throttle valve to its closed position;

said spring holder sleeve further comprising:

a first flange extending radially outwardly from said first end of said outer sleeve for holding said outer torsion coil spring against axial movement, said first flange having an outer diameter larger than the inner diameter of said outer torsion coil spring; and a second flange extending radially outwardly from said second end of said outer sleeve for holding said outer torsion coil spring against axial movement, said second flange also extending continuously over substantially entire circumference of said outer sleeve, said second flange having a maximum outer diametrical dimension substantially equal to the inner diameter of said outer torsion coil spring, and said second flange being eccentric with respect to said outer sleeve by an amount effective to prevent said outer torsion coil spring from being dislocated from the outer sleeve.

2. A return spring assembly as claimed in claim 1, wherein said second flange of said spring holder sleeve has a circular configuration having an outer diameter equal to or less than the inner diameter of said outer torsion coil spring.

3. A return spring assembly as claimed in claim 1, wherein said second flange of said spring holder sleeve has an oval configuration.

4. A return spring assembly as claimed in claim 1, wherein said second flange of said spring holder sleeve has a polygonal configuration.

* * * * *